US009695663B2

(12) United States Patent
Borak, Jr. et al.

(10) Patent No.: US 9,695,663 B2
(45) Date of Patent: Jul. 4, 2017

(54) COMBINATION FLUID PUMPING SUB AND HANGER LOCKDOWN TOOL

(71) Applicant: GE Oil & Gas Pressure Control LP, Houston, TX (US)

(72) Inventors: Eugene Allen Borak, Jr., Houston, TX (US); Gajanan B. Hegde, Houston, TX (US); Andrew Browne Helvenston, Houston, TX (US)

(73) Assignee: GE OIL & GAS PRESSURE CONTROL LP, Houston, TX (US)

( * ) Notice: Subject to any disclaimer, the term of this patent is extended or adjusted under 35 U.S.C. 154(b) by 427 days.

(21) Appl. No.: 14/196,874

(22) Filed: Mar. 4, 2014

(65) Prior Publication Data

US 2014/0352977 A1 Dec. 4, 2014

Related U.S. Application Data

(60) Provisional application No. 61/828,853, filed on May 30, 2013.

(51) Int. Cl.
*E21B 33/04* (2006.01)
*E21B 33/068* (2006.01)

(52) U.S. Cl.
CPC ..... *E21B 33/068* (2013.01); *E21B 33/04* (2013.01)

(58) Field of Classification Search
CPC ..... E21B 33/04; E21B 33/068; E21B 33/038; F16L 19/00; F16L 19/005; F16L 19/0206; F16L 15/08; F16L 15/05
See application file for complete search history.

(56) References Cited

U.S. PATENT DOCUMENTS 3,103,068 A * 9/1963 Hinz ..... B21D 39/046 285/382.5
3,468,559 A * 9/1969 Ahlstone ..... E21B 33/043 166/332.5
3,809,158 A * 5/1974 Bonds ..... E21B 33/043 166/285
3,903,965 A * 9/1975 Ahlstone ..... E21B 33/043 166/182
3,933,202 A * 1/1976 Ahlstone ..... E21B 33/043 166/182

(Continued)

OTHER PUBLICATIONS

A PCT Search Report and Written Opinion issued in connection with corresponding PCT Application No. PCT/US2014/036025 on Apr. 2, 2015.

*Primary Examiner* — Kipp Wallace
(74) *Attorney, Agent, or Firm* — Hogan Lovells US LLP

(57) ABSTRACT

A tool for retaining an activator ring of a hanger within a wellhead assembly during a fluid pumping process includes an annular fluid pumping sub body having an end selectively coupled with a supply of fluids and a distal end selectively coupled with the hanger. An outer ring assembly circumscribes and rotates relative to the fluid pumping sub body. A retainer ring circumscribes the fluid pumping sub body and selectively abuts the activator ring. A plurality of biasing assemblies that are selectively compressible are located between the outer ring assembly and the retainer ring, so that when the fluid pumping sub body is coupled with the hanger, an axial lockdown force is maintained on the activator ring by the biasing assemblies during the fluid pumping process.

20 Claims, 4 Drawing Sheets

(56) References Cited

U.S. PATENT DOCUMENTS

| | | | | |
|---|---|---|---|---|
| 3,986,729 | A | 10/1976 | Taylor | |
| 4,067,062 | A * | 1/1978 | Baugh | E21B 33/047 166/125 |
| 4,697,828 | A | 10/1987 | Chou | |
| 5,080,174 | A | 1/1992 | Hynes | |
| 5,341,885 | A | 8/1994 | Bridges | |
| 6,516,875 | B2 | 2/2003 | Reilly et al. | |
| 8,573,328 | B1 | 11/2013 | Ganzinotti, II et al. | |

* cited by examiner

COMBINATION FLUID PUMPING SUB AND HANGER LOCKDOWN TOOL

CROSS REFERENCE TO RELATED APPLICATION

This application claims priority to and the benefit of U.S. Provisional Application Ser. No. 61/828,853, filed May 30, 2013, titled "Combination Cementing Sub and Hanger Lockdown Tool," the full disclosure of which is hereby incorporated herein by reference in its entirety for all purposes.

BACKGROUND

1. Field of Invention

This invention relates in general to production of oil and gas wells, and in particular to a hanger lockdown tool that also functions as a fluid pumping sub.

2. Description of Prior Art

Tubing, casing or other hangers, annulus seals and other wellhead assembly or well completion components are typically rigidly locked into the bore of the wellhead assembly or into any other receptacle in which they are landed with a lockdown mechanism, to ensure safe operating conditions. One such lockdown mechanism includes an activator ring that is set in an annulus formed between a hanger and an inner surface of a bore through the wellhead assembly. A lockdown ring which is coaxial with the activator ring generally has a profile surface that mates with profiles in the inner surface of the bore of the wellhead assembly. The activator ring urges the lockdown ring radially outward against the inner surface of the bore of the wellhead assembly. The mating of the profiles of the lockdown ring and the inner surface of the bore maintains the hanger in position within the wellhead assembly.

During fluid pumping operations while drilling and production fluids are pumped into the well through the wellhead, vibrations can cause the wedged activator ring to work loose, allowing the lockdown ring to disengage from the profiles of the wellhead assembly. This can occur, for example, during cementing operations. In order to prevent the loss of lockdown capability, traditionally, a specialty tool such as a threaded keeper ring can be screwed into the wellhead assembly to hold the activator ring in place before the fluid pumping sub is lowered into the wellhead assembly. The fluid pumping sub is a generally annular member that inserts into the wellhead assembly and whose lower end mates with an upper end of the hanger located within the wellhead assembly. However, installing a keeper ring requires an extra trip into the well as well as the time-extensive process of the removal of the blowout preventer, in order to provide access for the keeper ring to reach the activator ring.

SUMMARY OF THE DISCLOSURE

Embodiments of this disclosure provide for a lockdown force on the activator ring without removing the blowout preventer and without the need for an extra specialty tool. The lockdown force is instead provided by the fluid pumping sub tool using multiple compressible biasing assemblies in a manner that exerts a load on top of the activator ring even in situations having an unfavorable tolerance variation. Embodiments of the current disclosure further provide for multiple functionalities within a single device in that it both holds the activator ring down during fluid pumping, and acts as a fluid pumping sub. Additionally, the apparatuses and methods of this disclosure do not require the removal of the blowout preventer and reduce the number of trips into the well, which saves time and money.

In an embodiment of this disclosure, a tool for retaining an activator ring of a hanger within a wellhead during a fluid pumping process includes an annular fluid pumping sub body having a proximal end selectively coupled with a supply of fluids and a distal end selectively coupled with the hanger. An outer ring assembly circumscribes and rotates relative to the fluid pumping sub body. A retainer ring circumscribes the fluid pumping sub body and selectively abuts the activator ring. A plurality of biasing assemblies that are selectively compressible are located between the outer ring assembly and the retainer ring, so that when the fluid pumping sub body is coupled with the hanger, an axial lockdown force is maintained on the activator ring by the biasing assemblies during the fluid pumping process.

In an alternative embodiment, a tool for retaining an activator ring of a hanger within a wellhead during a fluid pumping process has an annular fluid pumping sub body selectively attached to the hanger. The fluid pumping sub body has a central portion and a lower portion axially adjacent the central portion. The central lower portion has an outer diameter less than an outer diameter of the central portion. An outer ring assembly circumscribes and can rotate relative to the central portion of the fluid pumping sub body. A retainer ring circumscribes the lower portion of the fluid pumping sub body and has a downward facing surface in selective contact with the activator ring. A plurality of biasing assemblies axially are compressible between the outer ring assembly and retainer ring, so that when fluids flow through the fluid pumping sub body during a fluid pumping process, an axial lockdown force is applied to the activator ring from the retainer ring.

In yet another embodiment of the current disclosure, a method for retaining an activator ring of a hanger within a wellhead assembly during a fluid pumping process includes coupling an annular fluid pumping sub tool with the hanger and flowing fluids through the fluid pumping sub tool and into the hanger. A lockdown force is exerted onto the hanger with a retainer ring that circumscribes the fluid pumping sub tool and is axially moveable with respect to the fluid pumping sub tool so that the hanger remains locked down while fluids flow through the hanger.

BRIEF DESCRIPTION OF THE DRAWINGS

Some of the features and benefits of the present invention having been stated, others will become apparent as the description proceeds when taken in conjunction with the accompanying drawings, in which.

DETAILED DESCRIPTION OF THE DISCLOSURE

Figure 1:
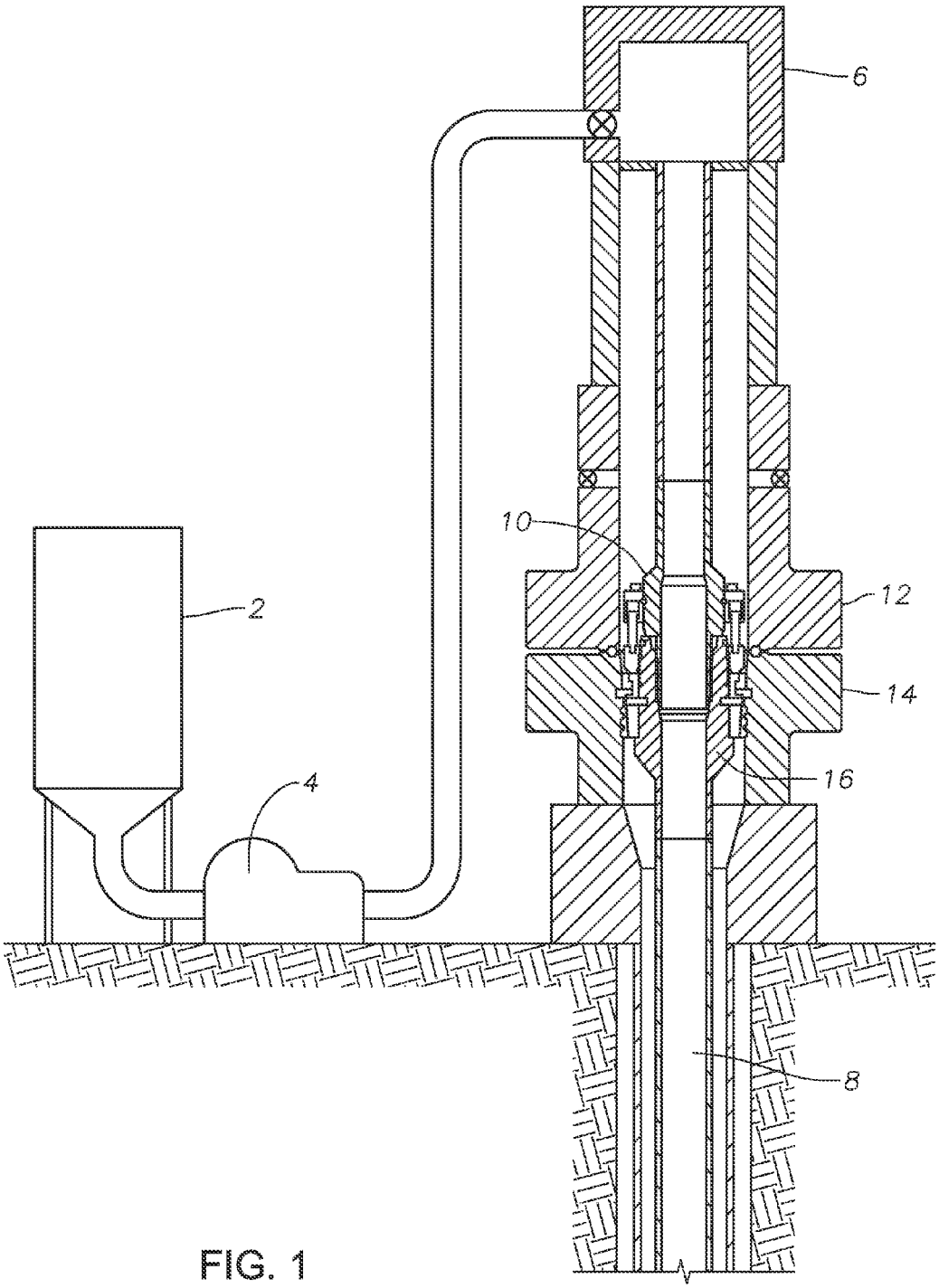
FIG. 1 is a partial sectional schematic view of a fluid pumping system with the combination fluid pumping sub and lockdown tool.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in FIG. 1 is a schematic example of a fluid pumping system for subterranean well, such as a well for producing hydrocarbons. Drilling and production fluids from a fluid bin 2 can be pumped with a pumping unit 4 to a fluid pumping head 6 mounted above a well 8. The fluids can then be flowed through fluid pumping sub tool 10 and into well 8. The fluid pumping system of FIG. 1 can be, for example, a cement pumping system for pumping cement into well 8.

Figure 2:
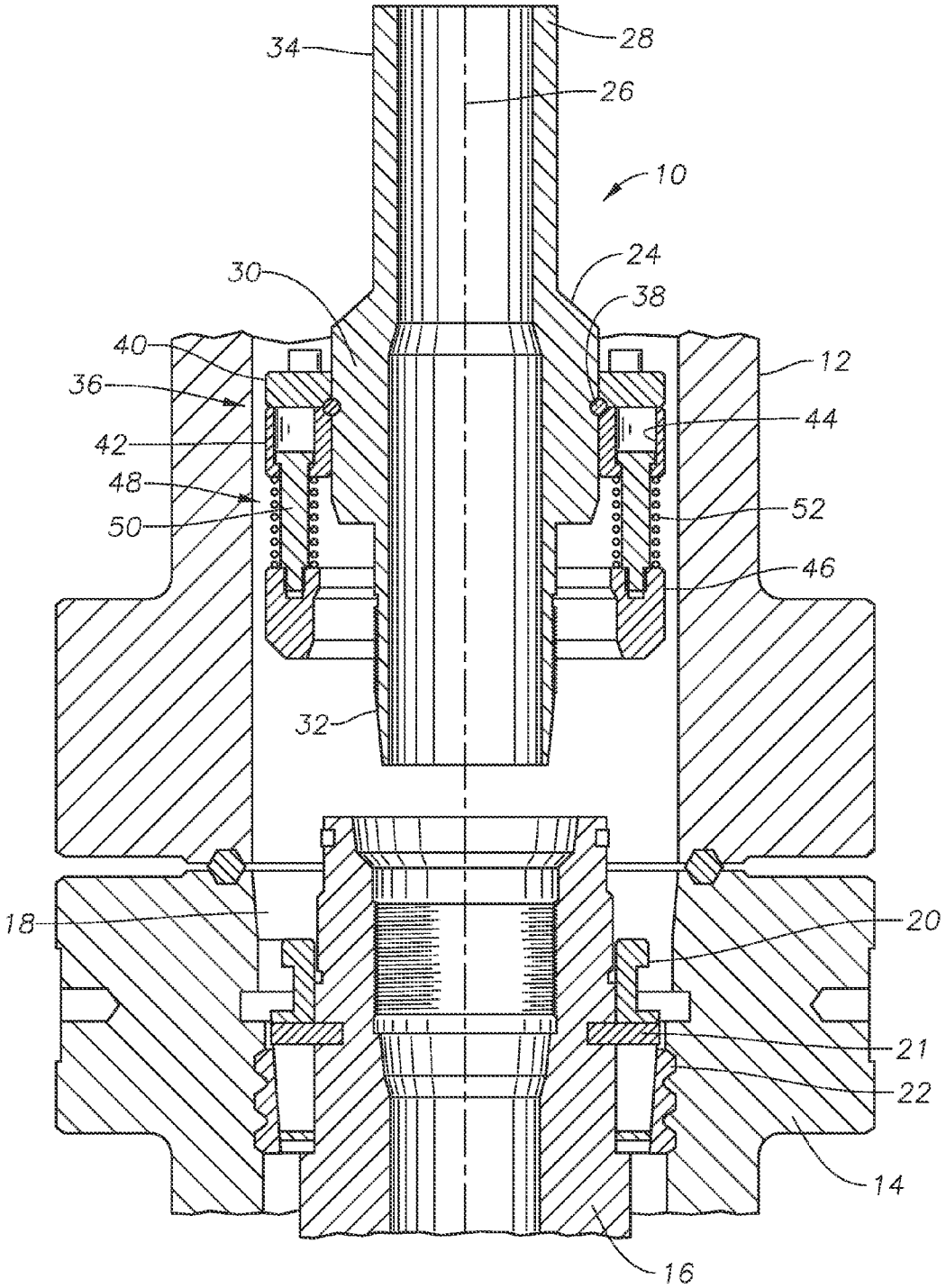
FIG. 2 is a section view of a combination fluid pumping sub and lockdown tool being lowered through a blowout preventer in accordance with an embodiment of this disclosure.

Shown in FIG. 2 is an example of a fluid pumping sub tool 10 being lowered through a blowout preventer 12 towards a wellhead assembly 14. Looking at FIGS. 1-3, wellhead assembly 14 can be a multibowl system or other type of wellhead system known in the art. Blowout preventer 12 is bolted or otherwise secured to the wellhead assembly 14. A hanger 16 is located within the bore of the wellhead assembly 14. Hanger 16 can be a tubing hanger with a string of tubing depending downward therefrom into the wellbore below wellhead assembly 14, or a casing hanger with a string of casing that depends downward into the wellbore. An annulus 18 is formed between the inner surface of the bore of the wellhead assembly 14 and the outer surface of the hanger 16. An activator ring 20 is set in the annulus 18. A lockdown ring 22 is located coaxial with the activator ring 20 and shown circumscribing a lower portion of activator ring 20. A number of anti-rotation pins 21 are shown mounted in an outer surface of the hanger 16 and projecting radially outward into slots that extend axially through the sidewall of activator ring 20. Pins 21 limit rotation between hanger 16 and activator ring 20 while allowing relative axial movement between hanger 16 and activator ring 20.

Lockdown ring 22 can have a profile surface that mates with profiles in the inner surface of the bore of the wellhead assembly 14. The activator ring 20 urges the lockdown ring 22 radially outward against the inner surface of the bore of the wellhead assembly. The mating of the profiles of the lockdown ring 22 and the inner surface or the bore maintains the hanger 16 in position within the wellhead assembly 14, so that downward relative movement of the activator ring 20 with respect to the lockdown ring 22 exerts a radially outward force against lockdown ring 22 thereby increasing its engaging contact force with the inner surface of the axial bore in the wellhead assembly 14.

Figure 3:
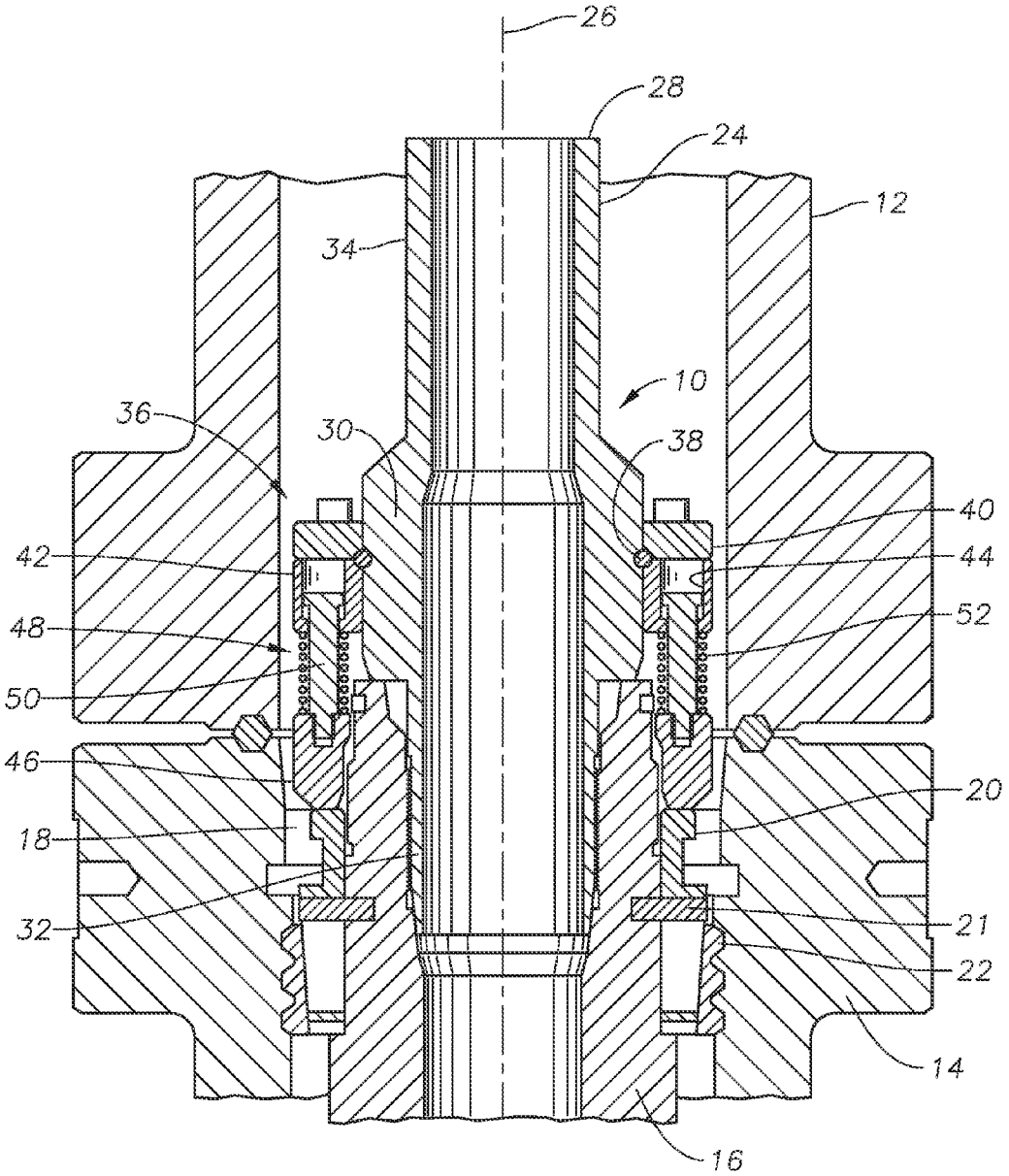
FIG. 3 is a section view of the combination fluid pumping sub and lockdown tool of FIG. 1 connected to a wellhead assembly.
Figure 4:
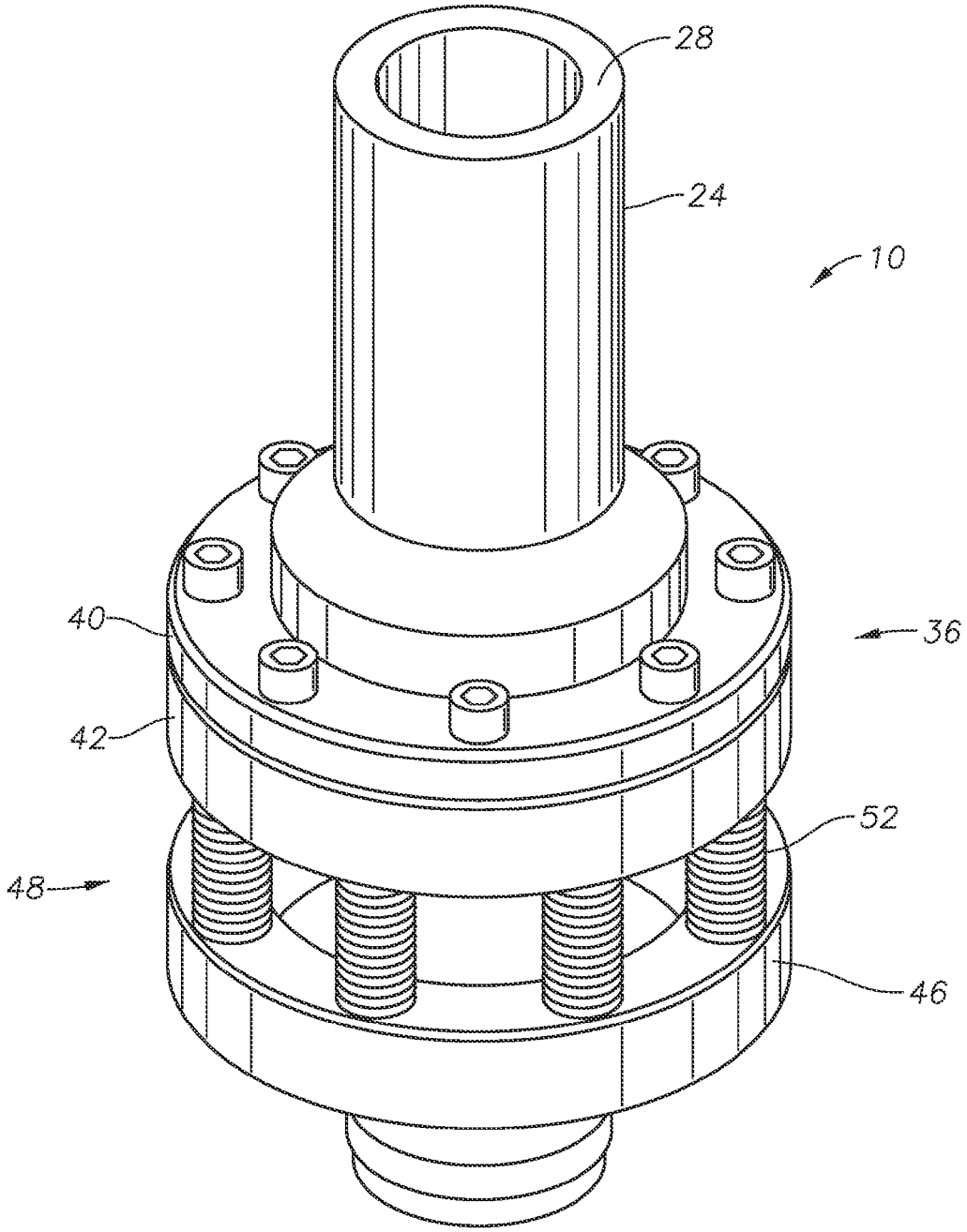
FIG. 4 is a perspective view of the combination fluid pumping sub and lockdown tool of FIG. 1.

Looking at FIGS. 2-4, the fluid pumping sub tool 10 includes an annular fluid pumping sub body 24. Fluid pumping sub body 24 is an elongated body along a central axis 26 and has an annular sidewall 28 circumscribing the axis 26 to define a central bore. Fluid pumping sub body 24 includes a central portion 30 and flanking portions on both ends of the central portion 30 that extend axially away from central portion 30. Central portion 30 has an enlarged outer diameter relative to the outer diameter of at least one flanking portion, such as lower portion 32, which has a reduced outer diameter. In certain embodiments the other flanking portion, upper portion 34, can also have a reduced outer diameter. The enlarged outer diameter of central portion 30 can result in a greater thickness of sidewall 28 in the central portion than in the upper and lower portions 32, 34. The fluid pumping sub tool 10 can have threads on the outer surface of the lower portion 32 for connecting the fluid pumping sub tool 10 to hanger 16.

Fluid pumping sub tool 10 also includes an outer ring assembly 36. Outer ring assembly 36 circumscribes fluid pumping sub body 24 and is rotatably connected to the central portion 30 of fluid pumping sub body 24 so that the fluid pumping sub body 24 can rotate relative to the outer ring assembly 36. A plurality of ball bearings 38 located between the fluid pumping sub body 24 and the outer ring assembly 36 rotatably connect the outer ring assembly 36 to the fluid pumping sub body 24. Ball bearings 38 are located in a circumferential groove formed in part by a groove in an outer surface of the fluid pumping sub body 24 and formed in part by a groove in an inner surface of the outer ring assembly 36. In this manner, ball bearings 38 limit relative axial movement between the outer ring assembly 36 to the fluid pumping sub body 24 while allowing for relative rotational movement between the fluid pumping sub body 24 and the outer ring assembly 36 so that the fluid pumping sub body 24 can be rotated independent of outer ring assembly 36.

Outer ring assembly 36 includes a top ring 40 and an annular ring 42 secured to the top ring 40. The annular ring 42 can be secured to a bottom side of the top ring 40 with threaded fasteners or by other known means. The annular ring 42 has a plurality of apertures 44 spaced circumferentially around the annular ring 42. The apertures 44 extend axially through annular ring 42 and have a larger diameter at their top end than at their bottom end.

Fluid pumping sub tool 10 additionally includes a retainer ring 46. Retainer ring 46 circumscribes the fluid pumping sub body 24 at the lower portion 34. The retainer ring 46 is spaced radially outward from the fluid pumping sub body 24, defining an annulus between the fluid pumping sub body 24 and the retainer ring 46. When the fluid pumping sub tool 10 is lowered into the wellhead assembly 14, the top end of hanger 16 can be received within this annulus and a downward facing surface of the retainer ring 46 can butt up against activator ring 20 so that retainer ring 46 can selectively contact the activator ring 20.

Fluid pumping sub tool 10 also has a plurality of biasing assemblies 48. Each biasing assembly 48 has a first end that engages the outer ring assembly 36 and a second end that engages the retainer ring 46. In the embodiments of FIGS. 2-3, each biasing assembly 48 includes a bolt 50. The stem of bolt 50 passes through the smaller diameter opening of aperture 44 on the bottom surface of the annular ring 42 and the head of the bolt 50 is located in a larger diameter portion of aperture 44 of the annular ring 42 of the outer ring assembly 36. The axial length of the head of bolt 50 is shorter than the axial length of aperture 44 so that the head of bolt 50 can move axially within aperture 44. The diameter of the head of bolt 50 is larger than the diameter of the smaller diameter opening of aperture 44 on the bottom surface of the annular ring 42. Therefore the head of bolt 50 cannot pass through the smaller diameter opening of aperture 44 on the bottom surface of the annular ring 42 and can instead contact the upward facing shoulder of aperture 44 defined by the transition between the larger diameter portion of aperture 44 and the smaller diameter opening of aperture 44 on the bottom surface of the annular ring 42. The stem of each bolt 50 extends axially downward from the outer ring assembly and the bolt threads of each bolt 50 engage a threaded hole of the retainer ring 46. In alternative embodiments, the head of each bolt 50 could instead engage the outer ring assembly 36 and the bolt threads could engage the retainer ring 46.

Each biasing assembly 48 includes a spring member 52. A first end of spring member 52 engages a surface of the outer ring assembly 36 and a second end of spring member 52 engages an opposite facing surface of the retainer ring 46. Spring member 52 is biased so that it urges retainer ring 46 away from the outer ring assembly 36. In the embodiments of FIGS. 2-3, spring member 52 circumscribes bolt 50. Spring member 50 can be a stack of Belleville washers. In alternative embodiments, biasing assembly 48 can include a piston, spring, or other resilient devices or systems that are biased to urge retainer ring 46 away from the outer ring assembly 36.

In an example of operation, after hanger 16 is landed within wellhead assembly 14 a lower end of the activator ring 20 pushes lockdown ring 22 radially outward and into locking engagement with a profile on an inner surface of a main bore through the wellhead assembly 14, setting the internal lockdown feature. The fluid pumping sub tool 10 is lowered through the blowout preventer and into the wellhead assembly 14 by drill pipe, casing, or tubing. The fluid pumping sub body 24 is located within the bore of the hanger 16 and the thread on the outer surface of the distal end or lower portion 34 of the fluid pumping sub body 24 is aligned with a thread on the hanger 16. The fluid pumping sub body 24 is rotated to thread the fluid pumping sub body 24 into the hanger 16. The top end of hanger 16 is positioned within the annulus defined by the fluid pumping sub body 24 on the inside, and the retainer ring 46 and biasing assembly 48 on the outside.

During the threading process, the bottom of the retainer ring 46 contacts the top of the activator ring 20. With continued threading, the biasing assemblies 48 compress, causing the retainer ring 46 to apply an increasing downward axial force on the activator ring 20. The biasing assembly 48 provides elastic compression so that the fluid pumping sub body 24 can thread into the hanger 24 and the retainer ring 46 will maintain an axial hold down or lockdown force on the activator ring 20 to keep the activator ring 20 in place. As the biasing assembly 48 compresses, the heads of bolts 50 move axially upward within apertures 44. The ball bearings 38 allow the fluid pumping sub body 24 to rotate independently from the outer ring assembly 36 so that after the bottom of the retainer ring 46 contacts the top of the activator ring 20, the threading process can continue without additional frictional resistance. The threading process is continued until a bottom shoulder of the fluid pumping sub body 24 contacts the top of the hanger 16. In this position, a seal on the bottom of the fluid pumping sub body 24 can be set inside the hanger 16.

With the fluid pumping sub tool 10 installed as shown in FIG. 2, drilling and production fluids can be pumped into the wellbore below the wellhead assembly 14 by flowing such fluids into a proximal end of fluid pumping sub body 24 and through the fluid pumping sub body 24. The axial force applied by the retainer ring 46 on the activator ring 20 created by the compressed biasing assembly 48, prevents the activator ring 20 from backing out while fluids are pumped into the wellhead. Because of the elastic nature of the biasing assembly 48, the axial force can be maintained even if the tolerances within the wellhead assembly 14 are greater than expected or vary over distance or time. The fluid pumping sub tool 10 operates as a fluid pumping sub during the fluid pumping process. Therefore embodiments of the current disclosure provide for an axial force on the activator ring 20 to hold it in pace during the fluid pumping process without removing the blowout preventer 12 and without the need for an extra specialty tool. This reduces the number of trips into the well, which saves time and money.

The terms "vertical", "horizontal", "upward", "downward", "above", and "below" and similar spatial relation terminology are used herein only for convenience because elements of the current disclosure may be installed in various relative positions.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A tool for retaining an activator ring of a hanger within a wellhead assembly during a fluid pumping process, the tool comprising:

a fluid pumping sub body having a proximal end selectively coupled with a supply of fluids and a distal end selectively coupled with the hanger;

an outer ring assembly circumscribing and rotatable relative to the fluid pumping sub body;

a retainer ring circumscribing the fluid pumping sub body that selectively abuts the activator ring, wherein the activator ring is axially moveable relative to the hanger; and a plurality of biasing assemblies that are selectively axially compressible between the outer ring assembly and the retainer ring, so that when the fluid pumping sub body is coupled with the hanger, an axial lockdown force is maintained on the activator ring by the biasing assemblies during the fluid pumping process: wherein the activator ring is positioned to engage a lockdown ring such that the lockdown ring moves radially in response to axial movement of the activator ring.

2. The tool of claim 1, further comprising a plurality of ball bearings located between the fluid pumping sub body and the outer ring assembly for axially coupling the outer ring assembly to the fluid pumping sub body.

3. The tool of claim 1, wherein the outer ring assembly includes a top ring and an annular ring secured to the top ring, the biasing assemblies engaging a surface of the annular ring.

4. The tool of claim 1, wherein each biasing assembly comprises:

a bolt, a head of the bolt engaging one of the outer ring assembly and the retainer ring, and threads of the bolt engaging the other of the outer ring assembly and the retainer ring; and a spring member circumscribing the bolt, a first end of the spring member engaging a surface of the outer ring assembly and a second end of the spring member engaging an opposite facing surface of the retainer ring, the spring member urging the retainer ring away from the outer ring assembly.

5. The tool of claim 4, wherein the spring member comprises a plurality of Belleville washers.

6. The tool of claim 1, wherein the fluid pumping sub body has threads for selectively connecting the fluid pumping sub body to the hanger.

7. The tool of claim 1, wherein the fluid pumping sub body has a central portion with an enlarged outer diameter and the outer ring assembly is rotatably connected to the central portion.

8. The tool of claim 1, wherein:

the fluid pumping sub body has a central portion with an enlarged outer diameter and a flanking portion on an end of the central portion with a reduced outer diameter; and the retainer ring circumscribes the flanking portion, defining an annulus between the fluid pumping sub body and the retainer ring for selectively receiving the hanger.

9. A tool for retaining an activator ring of a hanger within a wellhead during a fluid pumping process, the tool comprising:

a fluid pumping sub body selectively attached to the hanger, and having a central portion and a lower portion axially adjacent the central portion, the lower portion having an outer diameter less than an outer diameter of the central portion;

an outer ring assembly circumscribing and rotatable relative to the central portion of the fluid pumping sub body;

a retainer ring circumscribing the lower portion of the fluid pumping sub body and having a downward facing surface in selective contact with the activator ring, wherein the activator ring is axially moveable relative to the hanger; and a plurality of biasing assemblies axially compressible between the outer ring assembly and retainer ring, so that when fluids flow through the fluid pumping sub body during a fluid pumping process, an axial lockdown force is applied to the activator ring from the retainer ring; wherein the activator ring is positioned to engage a lockdown ring such that the lockdown ring moves radially in response to axial movement of the activator ring.

10. The tool of claim 9, further comprising a plurality of ball bearings located between the fluid pumping sub body and the outer ring assembly for axially connecting the outer ring assembly to the fluid pumping sub body, and so that the fluid pumping sub body can rotate relative to the outer ring assembly.

11. The tool of claim 9, wherein the outer ring assembly includes:

a top ring;

an annular ring secured to a bottom side of the top ring, the annular ring having a plurality of apertures spaced circumferentially around the annular ring; and wherein a first end of each biasing assembly is located in one of the apertures of the annular ring.

12. The tool of claim 9, wherein each biasing assembly comprises:

a bolt, a head of the bolt located in an aperture of the outer ring assembly and threads of the bolt engaging the retainer ring; and a spring member circumscribing the bolt, a first end of the spring member engaging a surface of the outer ring assembly and a second end of the spring member engaging an opposite facing surface of the retainer ring, the spring member urging the retainer ring away from the outer ring assembly.

13. The tool of claim 9, wherein:

the fluid pumping sub body has threads on an outer surface of the lower portion for selectively connecting the fluid pumping sub body to the hanger; and the retainer ring is spaced radially outward from the fluid pumping sub body, defining an annulus between the fluid pumping sub body and the retainer ring for selectively receiving a top end of the hanger.

14. A method for retaining an activator ring of a hanger within a wellhead assembly during a fluid pumping process, the method comprising:

coupling an annular fluid pumping sub tool with the hanger;

flowing fluids through the fluid pumping sub tool and into the hanger; and exerting a lockdown force onto the activator ring that is axially moveable relative to the hanger with a retainer ring that circumscribes the fluid pumping sub tool and is axially moveable with respect to the fluid pumping sub tool to move a lockdown ring radially in response to axial movement of the activator ring, so that the hanger remains locked down while the fluids flow through the hanger;

wherein the fluid pumping sub tool comprises a fluid pumping sub body with an axis, an outer ring assembly circumscribing and rotatable relative to the fluid pumping sub body, and a plurality of biasing assemblies with a first end engaging the outer ring assembly and a second end engaging the retainer ring, wherein the step of coupling the fluid pumping sub tool with the hanger includes rotating the fluid pumping sub body independent from the retainer ring.

15. The method of claim 14, wherein the fluid pumping sub tool includes a plurality of ball bearings located between the fluid pumping sub body and the outer ring assembly.

16. The method of claim 14, wherein each biasing assembly include a first end that engages a surface of the outer ring assembly and a second end that engages an opposite facing surface of the retainer ring, the spring member urging the retainer ring away from the outer ring assembly, the method further comprising the step of maintaining the axial force on the activator ring during the fluid pumping process with the spring member.

17. The method of claim 14, wherein the step of rotating the fluid pumping sub body includes compressing the biasing assemblies between the activator ring and the retainer ring to increase the axial force on the activator ring.

18. The method of claim 14, wherein each of the biasing assemblies include a plurality of Belleville washers and the step of applying axial force to the activator ring includes urging the retainer ring away from the outer ring assembly with the Belleville washers.

19. The method of claim 14, further comprising lowering the fluid pumping sub tool through a blowout preventer.

20. A tool for retaining an activator ring of a hanger within a wellhead assembly during a fluid pumping process, the tool comprising:

an annular fluid pumping sub body having a proximal end selectively coupled with a supply of fluids and a distal end selectively coupled with the hanger;

an outer ring assembly circumscribing and rotatable relative to the fluid pumping sub body;

a retainer ring circumscribing the fluid pumping sub body that selectively abuts the activator ring, wherein the activator ring is axially moveable relative to the hanger; and a plurality of biasing assemblies that are selectively compressible between the outer ring assembly and the retainer ring, so that when the fluid pumping sub body is coupled with the hanger, an axial lockdown force is maintained on the activator ring by the biasing assemblies during the fluid pumping process; wherein the fluid pumping sub body has a central portion with an enlarged outer diameter and a flanking portion on an end of the central portion with a reduced outer diameter;

the retainer ring circumscribes the flanking portion, defining an annulus between the fluid pumping sub body and the retainer ring for selectively receiving the hanger; and the activator ring is positioned to engage a lockdown ring such that the lockdown ring moves radially in response to axial movement of the activator ring.

* * * * *